US006936779B2

(12) United States Patent
Rhein et al.

(10) Patent No.: US 6,936,779 B2
(45) Date of Patent: Aug. 30, 2005

(54) BYPASS RECLOSER ASSEMBLY

(75) Inventors: David A. Rhein, Columbia, MO (US); Hatim H. Taj, Columbia, MO (US); Jeffery L. Thomas, Columbia, MO (US)

(73) Assignee: Hubbell Incorporated, Orange, CT (US)

( * ) Notice: Subject to any disclaimer, the term of this patent is extended or adjusted under 35 U.S.C. 154(b) by 33 days.

(21) Appl. No.: 10/650,090

(22) Filed: Aug. 28, 2003

(65) Prior Publication Data

US 2005/0045460 A1 Mar. 3, 2005

(51) Int. Cl.[7] ..... H01H 31/00
(52) U.S. Cl. ..... 200/48 R; 200/48 KB
(58) Field of Search ..... 200/48 R, 48 P, 200/50.01–50.4, 48 SB, 48 KB; 218/12, 14, 15, 152; 361/601, 602

(56) References Cited

U.S. PATENT DOCUMENTS

| | | | | |
|---|---|---|---|---|
| 2,621,271 | A | | 12/1952 | Lindell |
| 3,080,466 | A | | 3/1963 | Froland |
| 3,178,543 | A | | 4/1965 | Albright et al. |
| 3,697,709 | A | | 10/1972 | Witkor |
| 3,932,715 | A | | 1/1976 | Milianowicz et al. |
| 4,031,346 | A | | 6/1977 | Bridges |
| 4,107,487 | A | | 8/1978 | Evans |
| 4,110,579 | A | | 8/1978 | Frink et al. |
| 4,502,132 | A | | 2/1985 | Nishikawa et al. |
| 4,541,033 | A | | 9/1985 | Saito |
| 4,622,443 | A | | 11/1986 | Mooz |
| 5,243,159 | A | | 9/1993 | Demissy |
| 6,127,637 | A | | 10/2000 | Estey et al. |
| 6,198,062 | B1 | | 3/2001 | Mather et al. |
| 6,525,274 | B1 | * | 2/2003 | Roberts ..... 200/48 R X |
| 6,538,206 | B1 | | 3/2003 | Roberts |
| 6,595,477 | B2 | | 7/2003 | Roberts |
| 6,713,679 | B2 | | 3/2004 | Roberts |
| 2002/0135964 | A1 | | 9/2002 | Murray |

* cited by examiner

*Primary Examiner*—James R. Scott
(74) *Attorney, Agent, or Firm*—Marcus R. Mickney; Mark S. Bicks; Alfred N. Goodman

(57) ABSTRACT

A bypass switch recloser assembly has a first switch assembly connected electrically in series to a second switch assembly. A bypass switch assembly is connected electrically in parallel to the first and second switch assemblies. A recloser assembly is connected electrically in series to the first and second switch assemblies and electrically in parallel to the bypass switch assembly. The first, second and bypass switch assemblies and the recloser are mounted on a support assembly. The support assembly mounts the bypass switch recloser assembly to a support.

19 Claims, 4 Drawing Sheets

BYPASS RECLOSER ASSEMBLY

FIELD OF THE INVENTION

The present invention relates to a bypass recloser assembly. More particularly, the present invention relates to a bypass recloser assembly having a first switch assembly, a second switch assembly and a recloser assembly electrically connected in series, a bypass switch assembly connected electrically in parallel to the first and second switch assemblies and the recloser. The first, second and bypass switch assemblies and the recloser are connected to a support assembly for mounting the recloser assembly to a support.

BACKGROUND OF THE INVENTION

Distribution reclosers are mounted to support structures in electrical power distribution systems to prevent longer than momentary disruptions of electrical service, such as might be caused by a short circuit, and to provide continuous electric service. For example, wind conditions often cause power lines strung between poles to swing, thereby momentarily touching each other or a grounded conductor. Additionally, objects may fall across exposed wires, arcing could occur, or other transitory events, such as lightning, could cause momentary power line short circuits or current surges that could bum out a fuse or trip a circuit breaker. Most of these faults are transient arcing faults, as opposed to permanent faults, and do not require permanent fuse or circuit breaker protection. Reclosers sense and interrupt fault currents, thereby extinguishing transient arcing faults, and automatically restore service after the temporary fault condition is gone. If a fault is permanent, the recloser locks open after a preset number of operations and isolates the faulted section of the system from the main system.

Bypass switch assemblies may be used to provide an economical and practical method of bypassing current and disconnecting distribution reclosers to provide maintenance to the reclosers without interrupting electrical service. Once the recloser has been isolated from the electrical distribution system, maintenance may be performed on the recloser without impairing continuous electric power.

The recloser assemblies are mounted separately from the bypass switch assemblies, thereby causing a more difficult and time consuming installation. In addition to ensuring that the bypass switch assembly is securely mounted to the support, the installer must ensure that the recloser assembly is also securely mounted to the support. Mounting the recloser assembly separately from the bypass switch assembly also requires additional mounting parts. Thus, a need exists for a bypass recloser assembly that is quick and easy to install and mounts directly to the bypass switch assembly to reduce the inventory required for installation.

Once the recloser assembly has been secured to the support, the installer must make the electrical connection between the recloser assembly and the bypass switch assembly. Typically, wires provide the electrical connection between the recloser assembly and the bypass switch assembly. However, the electrical wires are prone to deteriorate over time due to stress caused by the elements, or other causes, such as birds, vandalism or shifting of the recloser assembly and the bypass switch assembly relative to one another. Thus, there is a need for a bypass recloser assembly that eliminates the electrical wires between the bypass assembly and the recloser assembly.

Thus, there is a continuing need to provide improved bypass recloser assemblies.

SUMMARY OF THE INVENTION

Accordingly, it is a primary objective of the present invention to provide an improved bypass recloser assembly.

A further objective of the present invention is to provide a bypass recloser assembly in which the recloser assembly is directly connected to the bypass switch assembly.

A further objective of the present invention is to provide a bypass recloser assembly that does not require electrical wires to provide the electrical connection between the recloser assembly and the bypass switch assembly.

A still further objective of the present invention is to provide a bypass switch assembly that is quick and easy to install.

A still further objective of the present invention is to provide a bypass switch assembly that reduces the number of parts required for installation, thereby reducing the required inventory of parts.

The foregoing objects are basically attained by providing a bypass switch recloser assembly. A first switch assembly is connected electrically in series to a second switch assembly. A bypass switch assembly is connected electrically in parallel to the first and second switch assemblies. A recloser assembly is connected electrically in series to the first and second switch assemblies and electrically in parallel to the bypass switch assembly. The first, second and bypass switch assemblies and the recloser are mounted on a support assembly. The support assembly mounts the bypass switch recloser assembly to a support.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
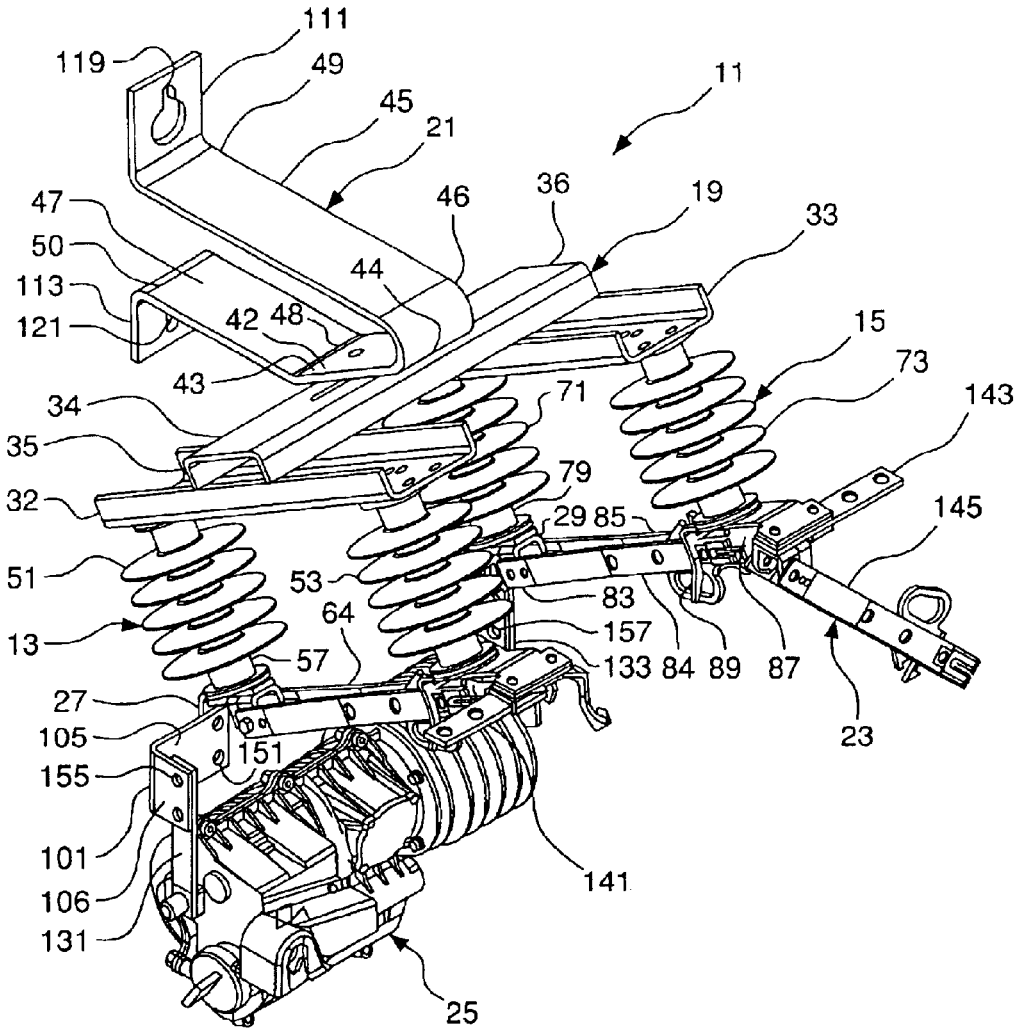
FIG. 1 is a perspective view of a bypass recloser assembly according to the present invention.

As shown in FIGS. 1–5, the present invention relates to a bypass recloser assembly 11. First and second switch assemblies 13 and 15 are mounted on a support assembly 19 secured to a support (not shown) by a mounting bracket 21. A bypass switch assembly 23 is electrically connected in parallel to the first and second switch assemblies 13 and 15, which are electrically connected in series. A recloser assembly 25 is secured to a first terminal pad 27 on the first switch assembly 13 and to a second terminal pad 29 on the second switch assembly 15 to provide both a mechanical and electrical connection. A recloser assembly that may be used is described in U.S. patent application Ser. No. 10/117,338 entitled Circuit Interrupting Device and filed on Apr. 8, 2002, now U.S. Pat. No. 6,753,493 which is hereby incorporated by reference in its entirety.

Figure 2:
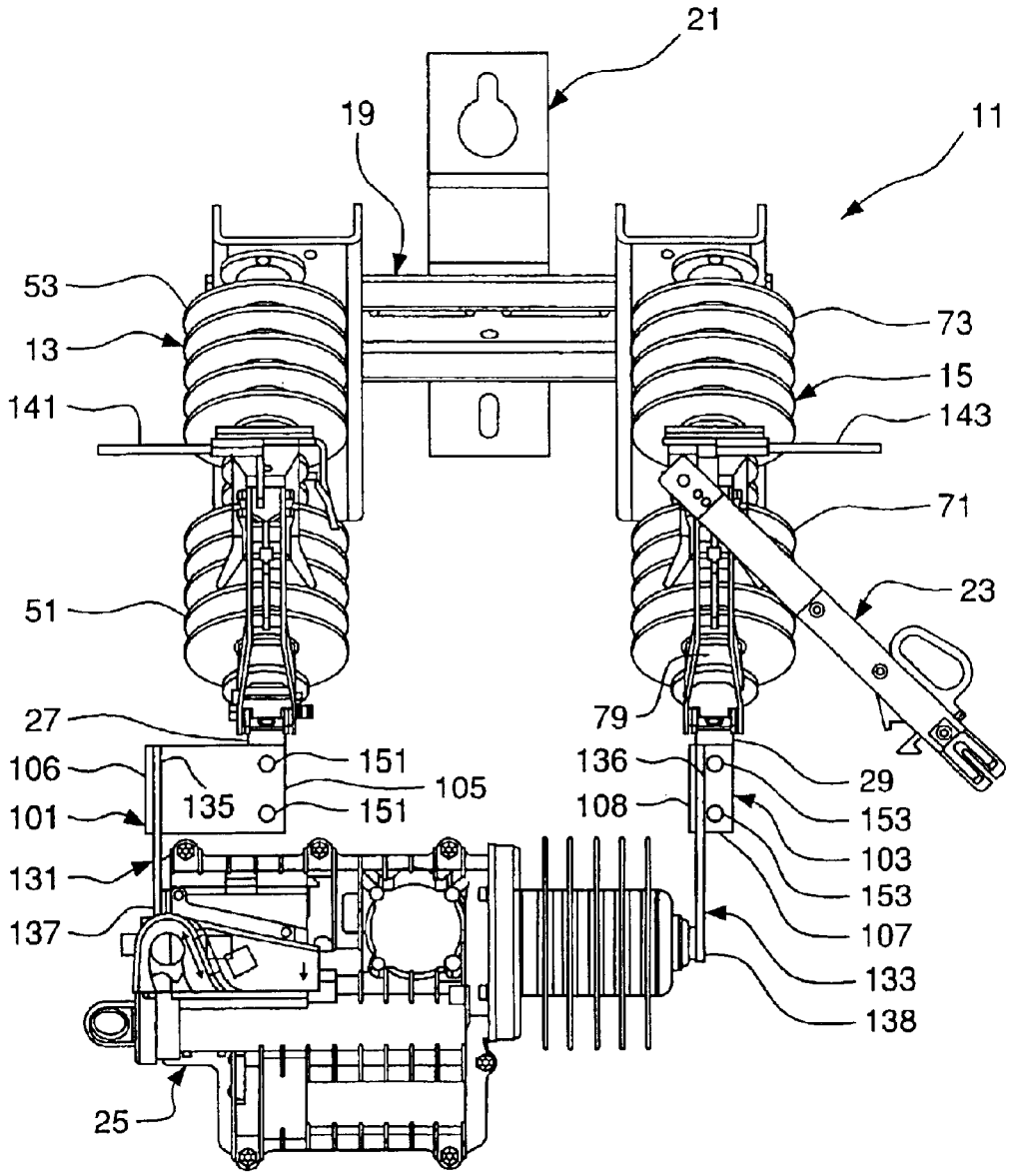
FIG. 2 is a front view of the bypass recloser assembly of FIG. 1.
Figure 3:
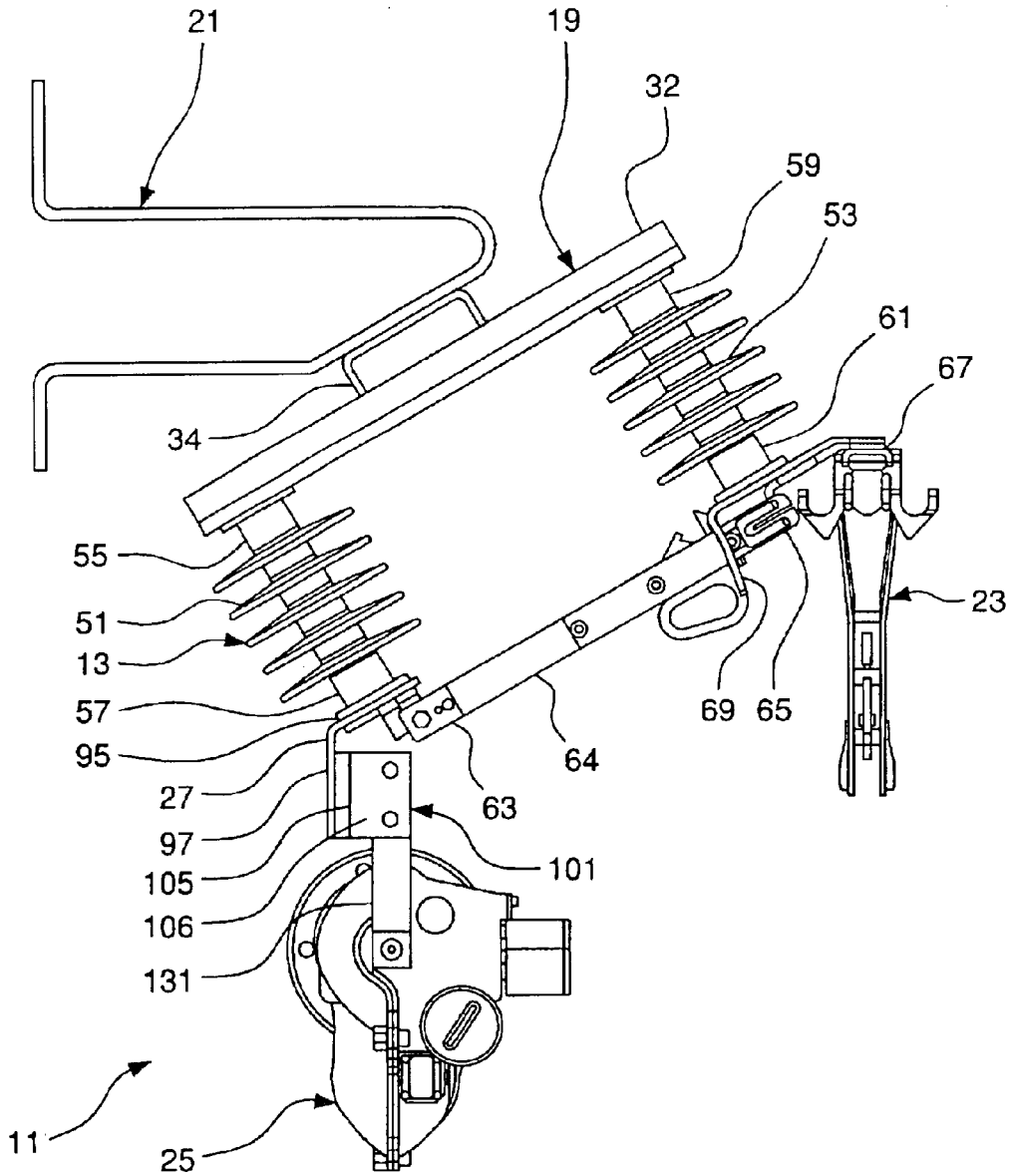
FIG. 3 is a side elevational view of the bypass recloser assembly of FIG. 1.

The first switch assembly 13, as shown in FIGS. 1–3, has first and second insulators 51 and 53. First insulator 51 has first and second end fittings 55 and 57 attached at opposite ends of the first insulator. Second insulator 53 also has first and second end fittings 59 and 61 attached at opposite ends of the second insulator. The first end fittings 55 and 59 of insulators 51 and 53 receive fasteners for mounting each insulator to a base assembly 19. A first end 63 of a first switch blade 64 is pivotally connected to the second end fitting 57 of the first insulator 51. A second end 65 of the first switch blade 64 is engaged with a first contact 67 that is connected to the second end fitting 61 of the second insulator 53. A first hook 69 connected to the second end fitting 61 guides the first switch blade 64 into electrical contact with the first contact 67 during closing of the first switch assembly 13.

The second switch assembly 15, as shown in FIGS. 1–2, is assembled similarly to the first switch assembly 13. The second switch assembly 15 has first and second insulators 71 and 73, respectively. First insulator 71 has first and second end fittings, similar to end fittings 55 and 57 attached at opposite ends of the first insulator. Second insulator 73 also has first and second end fittings, similar to end fittings 59 and 61 attached at opposite ends of the second insulator. The first end fittings of insulators 71 and 73 receive fasteners for mounting each insulator to a base assembly 19. A first end 83 of a second switch blade 84 is pivotally connected to the second end fitting of the first insulator 71. A second end 85 of the second switch blade 84 is engaged with a second contact 87 that is connected to the second end fitting of the second insulator 73. A second hook 89 connected to the second end fitting guides the second switch blade 84 into electrical contact with the second contact 87 during closing of the second switch assembly 15 and provides a connection point for a load break tool.

As shown in FIGS. 1–3, first terminal pad 27 is connected between the second end fitting 57 of the first insulator 51 of the first switch assembly 13 and the first end 63 of the first switch blade 64. As shown in FIGS. 1–2, second terminal pad 29 is connected between the second end fitting of the first insulator 71 of the second switch assembly 15 and the first end 83 of the second switch blade 84.

As shown in FIG. 3, the first terminal pad 27 has angularly oriented first and second portions 95 and 97, respectively. Preferably, the first and second portions 95 and 97 are integrally connected. Preferably, the angle between first and second portions 95 and 97 is less than 180 degrees. More preferably, the angle is approximately 120 degrees. An opening in the first portion 95 facilitates connecting the first terminal pad 27 to the second end fitting 57 of the first insulator 51 of the first switch assembly 13. Another opening in the second portion 97 receives a fastener to facilitate connecting a recloser bracket 101 (FIGS. 1–3) to the first terminal pad 27.

Base assembly 19, shown in FIGS. 1–3, has a first, second and third support members 32, 33 and 34, respectively. Preferably, each of the support members is substantially U-shaped in transverse cross section, as shown in FIG. 1. A first end 35 of third support member 34 is attached to first support member 32. A second end 36 of third support member 34 is attached to second support member 32. Preferably, third support member 34 is welded to first and second support members 32 and 33, respectively, thereby providing a rigid base assembly 19. Preferably, as shown in FIGS. 1–2, first and second support members 32 and 33 are substantially parallel and third support member 34 is substantially perpendicular to both first and second support members.

First and second support members 32 and 33 have a plurality of holes for receiving first and second insulators 51, 53, 71 and 73 of the first and second switch assemblies 13 and 15, respectively. The plurality of holes in the first and second support members are adapted to receive a variety of insulator configurations, thereby providing versatility to the base assembly. The third support member 34 also has a plurality of holes for connecting to a support structure or to the mounting bracket 21.

Mounting bracket 21, as shown in FIGS. 1–3, has a base 42 having first and second ends 43 and 44, respectively. A first leg 45 has a first end 46 attached to the first end 43 of the base 42. A second leg 47 has a first end 48 attached to the second end 44 of the base 42. Preferably, first leg 45 and second leg 47 are substantially parallel. A first foot 111 extends from second end 49 of first leg 45. A second foot extends 113 from second end 50 of second leg 47. Preferably, first foot 111 and second foot 113 extend in opposite directions from first and second legs 45 and 47, respectively. Preferably, base 42, first leg 45, first foot 111, second leg 47 and second foot 113 are integrally connected.

Fastener holes 119 and 121 in first and second feet 111 and 113, respectively, receive fasteners to secure mounting bracket 21 to a support (not shown), such as a utility pole. At least one fastener hole in the base 42 of the mounting bracket 21 receives a fastener to secure the mounting bracket to the base assembly 19.

Figure 4:
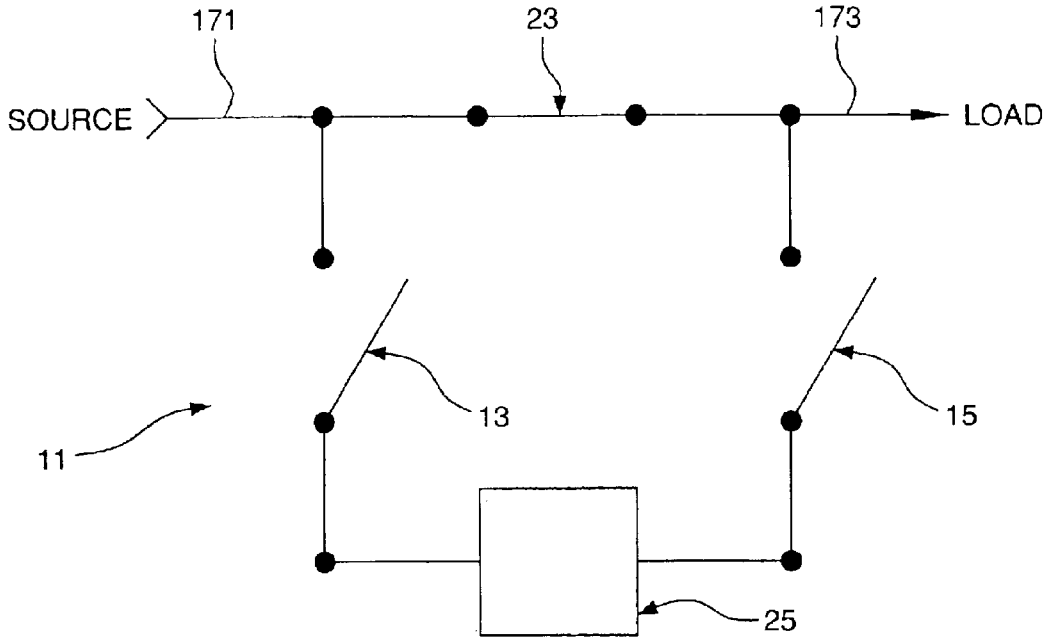
FIG. 4 is an electrical schematic diagram of the bypass recloser assembly in bypass operating position to disconnect the recloser assembly from the circuit.
Figure 5:
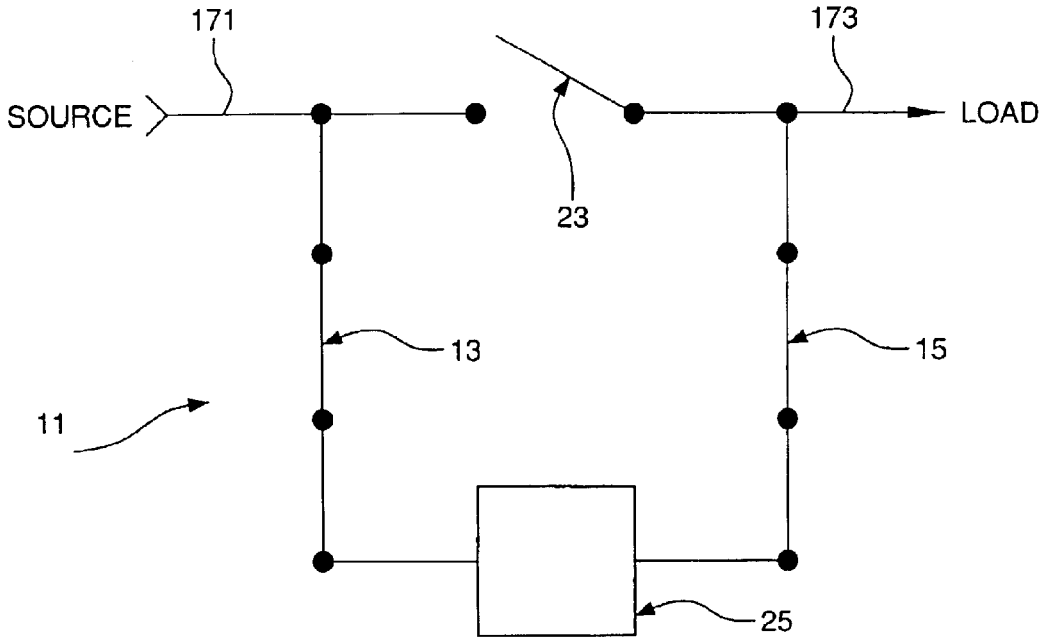
FIG. 5 is an electrical schematic diagram of the bypass recloser assembly in normal operating position in which the recloser assembly is electrically connected to the circuit.

The bypass switch assembly 23, as shown in FIGS. 1–3, allows for quick and easy bypassing and disconnecting of the recloser assembly 25 from the electrical distribution system. The bypass switch assembly 23 is shown in an open position in FIGS. 1–3 and is shown open in the schematic diagram in FIG. 5. The bypass switch assembly is shown closed in the schematic diagram in FIG. 4. The bypass switch assembly 19 has first and second terminal pads 141 and 143, respectively, for receiving and transferring electrical current. Connectors (not shown) may be attached to terminal pads 141 and 143 to receive electrical conductors 171 and 173 (FIGS. 4 and 5). A bypass blade 145 transfers electrical current from first terminal pad 141 to second terminal pad 143 when in a closed position, as shown in FIG. 4. In normal operation, bypass blade 145 is in an open position, as shown in FIGS. 1–3 and 5, and first and second switch blades 64 and 84 are in a closed position to transfer electrical current through the recloser assembly 25. Closing bypass blade 145 and opening first and second switch blades 64 and 84 electrically isolates the recloser assembly 25 from the electrical distribution system by conveying the electrical current from the first terminal pad 141 to the second terminal pad 143, thereby bypassing the first and second switch assemblies 13 and 15 and the recloser assembly 25, as shown in FIG. 4.

Electrically conductive first and second recloser brackets, or mounting brackets, 101 and 103 connect electrically conductive mounting arms 131 and 133 of the recloser assembly 25 to the first and second terminal pads 27 and 29 of the first and second switch assemblies 13 and 15, respectively, as shown in FIGS. 1–3. Preferably, the first and second brackets 101 and 103 are angled, having first portions 105 and 107 and second portions 106 and 108. Preferably, the recloser brackets 101 and 103 are substantially L-shaped. First portions 105 and 107 have openings 151 and 153 for receiving fasteners to connect the brackets 101 and 103 to the terminal pads 25 and 29. Second portions 106 and 108 have openings 155 and 157 for receiving fasteners to connect the brackets 101 and 103 to mounting arms 131 and 133, respectively. Preferably, the recloser brackets 101 and 103 are unitarily formed from a metal.

Mounting arms 131 and 133, as shown in FIGS. 1–3, connect the recloser assembly 25 to the recloser brackets 101 and 103. Mounting arms 131 and 133 have first ends 135 and 136 having openings that receive fasteners to secure the mounting arms to the brackets 101 and 103. Second ends 137 and 138 of the mounting arms 131 and 133 have an opening to receive a fastener to secure the recloser assembly 25 to the terminal pads 27 and 29 of the first and second switch assemblies 13 and 15. Preferably the mounting arms 131 and 133 are substantially rectangular and unitarily formed from a metal.

Assembly and Disassembly

As shown in FIGS. 1–3, the bypass recloser assembly 11 is fully constructed and ready to be mounted on a support (not shown). An electrical schematic of the bypass recloser assembly is shown in FIGS. 4–5, which shows how to isolate the recloser assembly from the circuit when maintenance or repair of the recloser assembly is required.

A bypass recloser assembly 11 according to the present invention is shown fully assembled in FIGS. 1–3. The bypass recloser assembly 11 has a base assembly 19 to which first and second switch assemblies 13 and 15 are mounted. A bypass switch assembly 23 may then be added by attaching a first end of the bypass switch assembly to the first switch assembly 13 and attaching a second end of the bypass switch assembly to the second switch assembly 15, as shown in FIGS. 1–3.

As shown in FIG. 1, the base assembly 19 is then secured by fasteners to the mounting bracket 21. The base assembly 19 may be directly secured to a support structure without mounting bracket 21. The mounting bracket 21 is then secured using fasteners to a support structure (not shown), such as a utility pole.

The recloser assembly 25 is mechanically and electrically connected to the terminal pads 27 and 29 of the first and second switch assemblies 13 and 15 through the mounting arms 131 and 133 and the recloser brackets 101 and 103. Therefore, no additional wires, conductors, or the like are required to electrically connect the recloser assembly 25 to the first and second switch assemblies, and thereby, the conductors 171 and 173 of the circuit. Electrical conductors 171 and 173 to and from the bypass recloser assembly 11 are connected to first and second terminal pads 141 and 143 of the bypass switch assembly.

Electrical circuit diagrams of the bypass recloser assembly 11 are shown in FIGS. 4 and 5. The normal operating mode is shown in FIG. 5. Electrical current is received at the first terminal pad 141 of bypass switch assembly 19 through conductor 171 (FIG. 4). Since bypass switch assembly 23 is in the open position, the electrical current is prevented from traveling through the bypass switch assembly. The electrical current is conveyed from the first terminal pad 141 of the bypass switch assembly 19, through the first contact 67 of the first switch assembly 13, through the first switch blade 64 of the first switch assembly, through the first terminal pad 27, through the first recloser bracket 101, and through the first mounting arm 131 to the recloser assembly 25. From the recloser assembly 25, the electrical current is conveyed through the second mounting arm 133, through the second recloser bracket 103, through the second terminal pad 29 of the second switch assembly 15, through the second switch blade 84 of the second switch assembly, through the second contact 87 of the second switch assembly, and through the second terminal pad 143 of the bypass switch assembly 23 to conductor 173.

The bypass mode of the bypass recloser assembly 11 is shown in FIG. 4. Both the first and second switch assemblies 13 and 15 are in the open position and the bypass switch assembly 23 is in the closed position. Since the first switch assembly 13 is open, electrical current travels through the bypass switch assembly 23 and is then transferred from the bypass recloser assembly 11, thereby bypassing the recloser assembly 25. The bypass mode electrically isolates the recloser assembly 25 from the electrical distribution system so work may be performed on the recloser assembly. Electrical current is received from conductor 171 by first terminal pad 141 of the bypass switch assembly 23. The electrical current is conveyed from the first terminal pad 141 through the bypass switch 145, and through the second terminal pad 143 of the bypass switch assembly 23 to the conductor 173.

While advantageous embodiments have been chosen to illustrate the invention, it will be understood by those skilled in the art that various changes and modifications may be made therein without departing from the scope of the invention as defined in the appended claims.

What is claimed is:

1. A bypass switch recloser assembly, comprising:

a first switch assembly;

a second switch assembly connected electrically in series to said first switch assembly;

a bypass switch assembly connected electrically in parallel to said first and second switch assemblies;

a recloser assembly connected electrically in series to said first and second switch assemblies and electrically in parallel to said bypass switch assembly; and a support assembly to which said first, second and bypass switch assemblies and said recloser assembly are mounted.

2. A bypass recloser assembly according to claim 1, wherein a first mounting bracket secures said support assembly to a support.

3. A bypass recloser assembly according to claim 1, wherein second and third mounting brackets electrically and mechanically connect recloser assembly to first and second terminal pads on said first and second switch assemblies, respectively.

4. A bypass recloser assembly according to claim 3, wherein first and second mounting arms electrically and mechanically connect said recloser assembly to one of said second and third mounting brackets.

5. A bypass recloser assembly according to claim 4, wherein said second and third mounting brackets are substantially L-shaped.

6. A bypass recloser assembly according to claim 5, wherein each of said second and third mounting brackets has a first portion connected to one of said first and second terminal pads, respectively, and a second portion connected to one of said first and second mounting arms, respectively.

7. A bypass recloser assembly according to claim 6, wherein said second and third mounting brackets are substantially L-shaped.

8. A bypass recloser assembly according to claim 7, wherein first and second mounting arms are substantially rectangular.

9. A bypass switch recloser assembly, comprising:

a first switch assembly having a first terminal pad;

a second switch assembly connected electrically in series to said first switch assembly and having a second terminal pad;

a bypass switch assembly connected electrically in parallel to said first and second switch assemblies;

a recloser assembly connected electrically in series to said first and second switch assemblies and electrically in parallel to said bypass switch assembly;

a support assembly mounting said first, second and bypass switch assemblies and said recloser assembly are mounted;

first and second mounting brackets connected to said first and second terminal pads, respectively; and first and second mounting arms connected to said second and third mounting brackets, respectively, said second and third mounting brackets and said first and second mounting arms connecting said recloser assembly electrically and mechanically to said first and second switch assemblies.

10. A bypass recloser assembly according to claim 9, wherein a second mounting bracket secures said support assembly to a support.

11. A bypass recloser assembly according to claim 9, wherein said first mounting bracket has a first portion connected to said first terminal pad and a second portion connected to said first mounting arm.

12. A bypass recloser assembly according to claim 11, wherein said second mounting bracket has a first portion connected to said second terminal pad and a second portion connected to said second mounting arm.

13. A bypass recloser assembly according to claim 12, wherein said first and second mounting brackets are substantially L-shaped.

14. A bypass recloser assembly according to claim 9, wherein first and second mounting arms are substantially rectangular.

15. A bypass switch recloser assembly, comprising:

a first switch assembly having a first terminal pad;

a second switch assembly connected electrically in series to said first switch assembly and having a second terminal pad;

a bypass switch assembly connected electrically in parallel to said first and second switch assemblies;

a recloser assembly connected electrically in series to said first and second switch assemblies and electrically in parallel to said bypass switch assembly;

a support assembly mounting said first, second and bypass switch assemblies and said recloser assembly are mounted;

a first mounting bracket securing said support assembly to a support;

second and third mounting brackets connected to said first and second terminal pads, respectively, said second mounting bracket having a first portion connected to said first terminal pad and a second portion, said third mounting bracket having a first portion connected to said second terminal pad and a second portion; and first and second mounting arms connected to said second portions of said second and third mounting brackets, respectively, said second and third mounting brackets and said first and second mounting arms connecting said recloser assembly electrically and mechanically to said first and second switch assemblies.

16. A bypass recloser assembly according to claim 15, wherein said second and third mounting brackets are substantially L-shaped.

17. A bypass recloser assembly according to claim 15, wherein said first and second mounting arms are substantially rectangular.

18. A bypass recloser assembly according to claim 15, wherein said second and third mounting brackets are metallic.

19. A bypass recloser assembly according to claim 15, wherein said first and second mounting arms are metallic.

* * * * *